US005107468A

United States Patent [19]

Lu

[11] Patent Number: 5,107,468

[45] Date of Patent: Apr. 21, 1992

[54] STRUCTURE OF WORLD TIME CLOCK FOR 24-HOUR INDICATION

[76] Inventor: Jem D. Lu, No. 36, Lane 360, Chung Cheng Road, Pan Chiao City, Taipei Hsien, Taiwan

[21] Appl. No.: 536,847

[22] Filed: Jun. 12, 1990

[51] Int. Cl.[5] ..... G04B 19/22

[52] U.S. Cl. ..... 368/27

[58] Field of Search ..... 368/27, 21–30, 368/20

[56] References Cited

U.S. PATENT DOCUMENTS

| | | | |
|---|---|---|---|
| 1,990,012 | 2/1935 | Woodruff | 368/21 |
| 2,056,038 | 9/1936 | Angelis et al. | 368/21 |
| 2,275,604 | 3/1942 | Booharin | 368/21 |

*Primary Examiner*—Bernard Roskoski

*Attorney, Agent, or Firm*—Lowe, Price, LeBlanc & Becker

[57] ABSTRACT

Disclosed is a world time clock, which has an hour plate designed to rotate at a constant speed of 24 hours for one turn. The hour plate is printed with the official name of world important countries according to world time zone classification so that every local time is shown while the hour plate is carried to rotate on a fixed plate which has graduations for indication of hour, minute and second. As an alternate form of the present invention, an hour plate is printed or engraved with graduations to match with a face plate, which is printed with the official name of world important countries according to world time zone classification, for world time indication.

6 Claims, 8 Drawing Sheets

STRUCTURE OF WORLD TIME CLOCK FOR 24-HOUR INDICATION

BACKGROUND OF THE INVENTION:

The present invention is related to clocks and more particularly to a world time clock for indicating the local time of every world time zone.

In communication or transportation from one country to another, one may have to know a local time of a far place beyond a country. A world time table is commonly used by people for checking a local time of different time zone. However, it is not convenient to check a specific local time by a world time table. In some hotels, different clocks may be mounted on a wall respectively for indicating the local time at different cities. Indeed, it is an economic way to indicate world time through several clocks.

The present invention utilizes a revolving hour plate or graduation dial for indicating world time through a single clock According to a first aspect of the present invention, a world time clock comprises a movement having an hour shaft designed to rotate at a constant speed of 24 hours for one turn.

According to a second aspect of the present invention, a world time clock comprises a fixed graduation dial matching with a revolving hour plate for world time indication, which revolving hour plate is printed with the official name or national flag of world important countries according to world time zone classification.

According to a third aspect of the present invention, a world time clock comprises a fixed face plate matching with a revolving graduation dial for world time indication, in which the face plate is printed with the official name or national flag of world important countries according to world time zone classification, and the graduation dial is driven by an hour shaft to rotate.

SUMMARY OF THE INVENTION

The present invention is to provide a world time clock, which has an hour plate designed to rotate at a constant speed of 24 hours for one turn. The hour plate is printed with the official name of world important countries according to world time zone classification so that every local time is shown while the hour plate is carried to rotate on a fixed plate which has graduations for indication of hour, minute and second. As an alternate form of the present invention, an hour plate is printed or engraved with graduations to match with a face plate, which is printed with the official name of world important countries according to world time zone classification, for world time indication.

BRIEF DESCRIPTION OF THE DRAWINGS

The present invention will now be described by way of examples with reference to the annexed drawings, in which.

DETAILED DESCRIPTION OF THE PREFERRED EMBODIMENT

Figure 1:
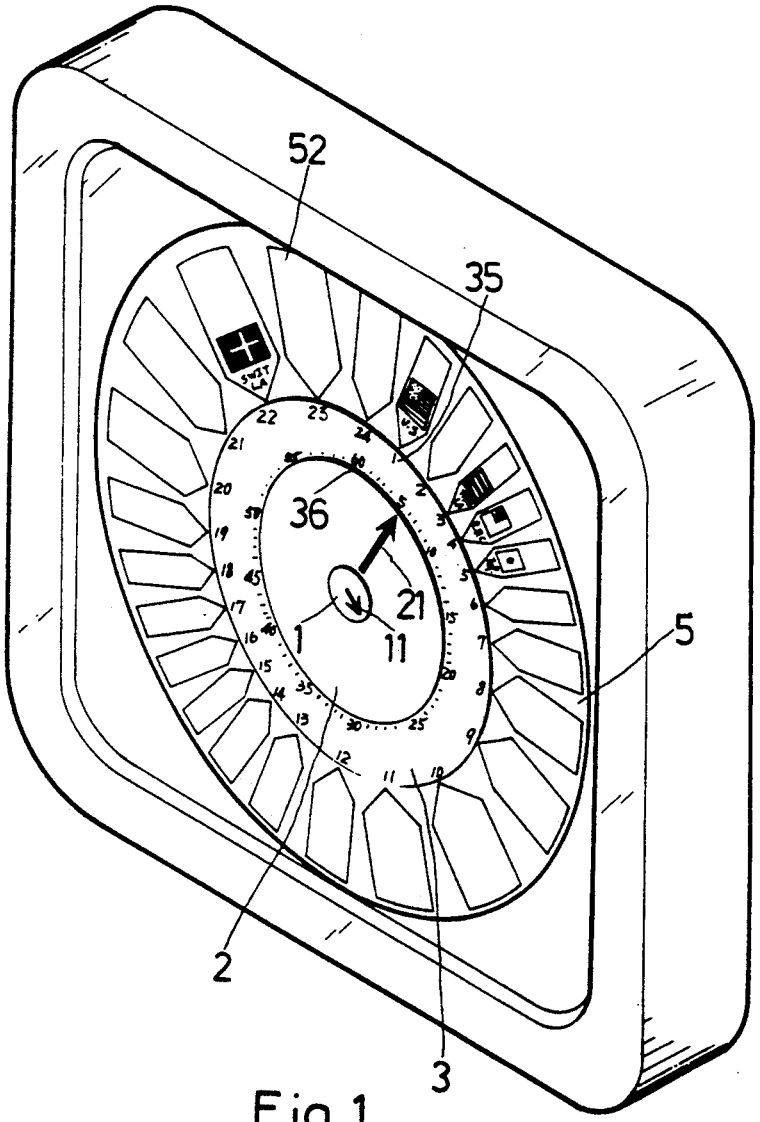
FIG. 1 is a perspective view of a world time clock embodying the present invention.
Figure 2:
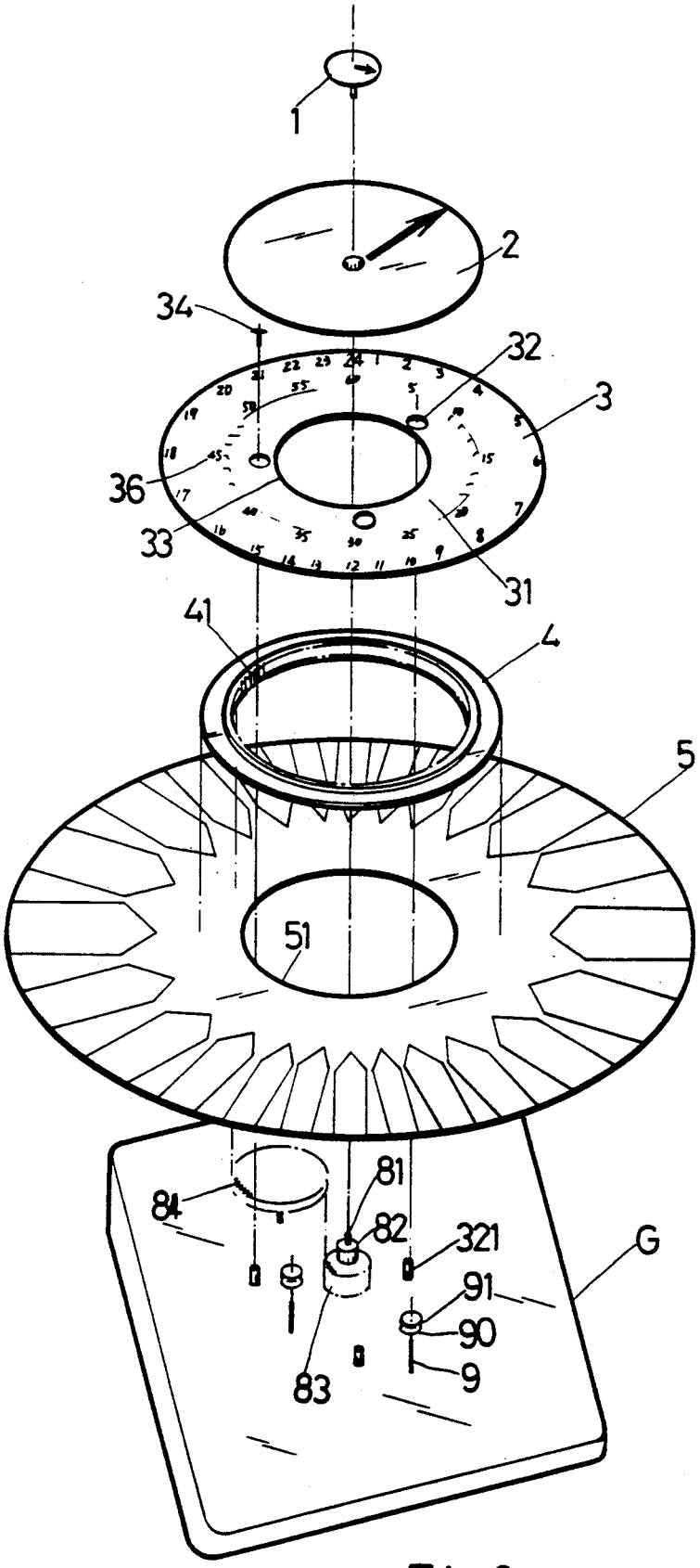
FIG. 2 is a partly perspective exploded view of thereof.
Figure 3:
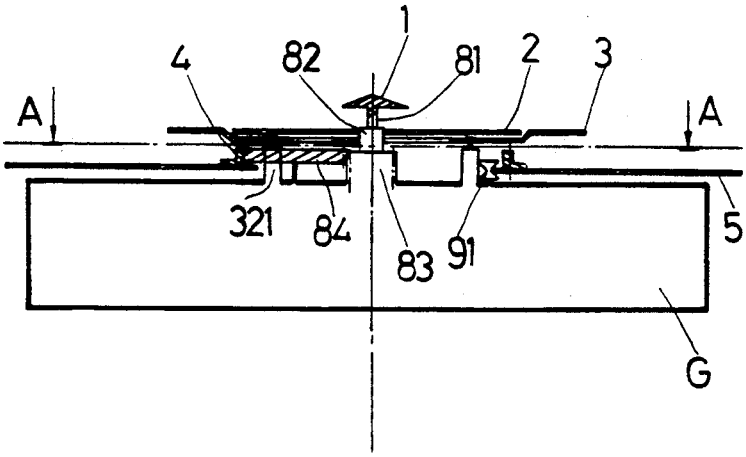
FIG. 3 is a sectional side view thereof.
Figure 4:
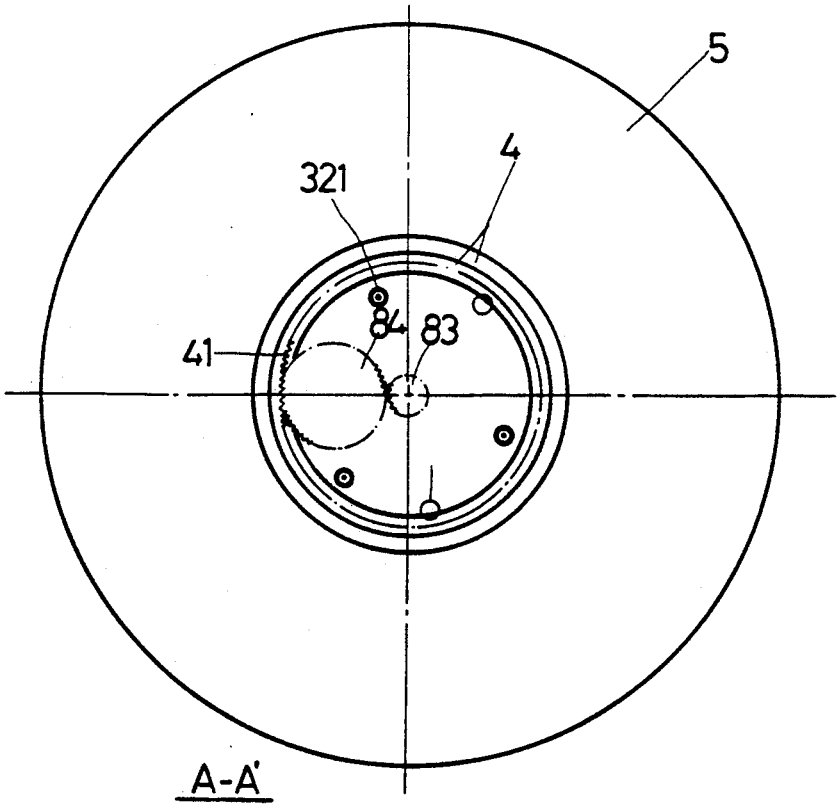
FIG. 4 is a partly schematic top view thereof.
Figure 5:
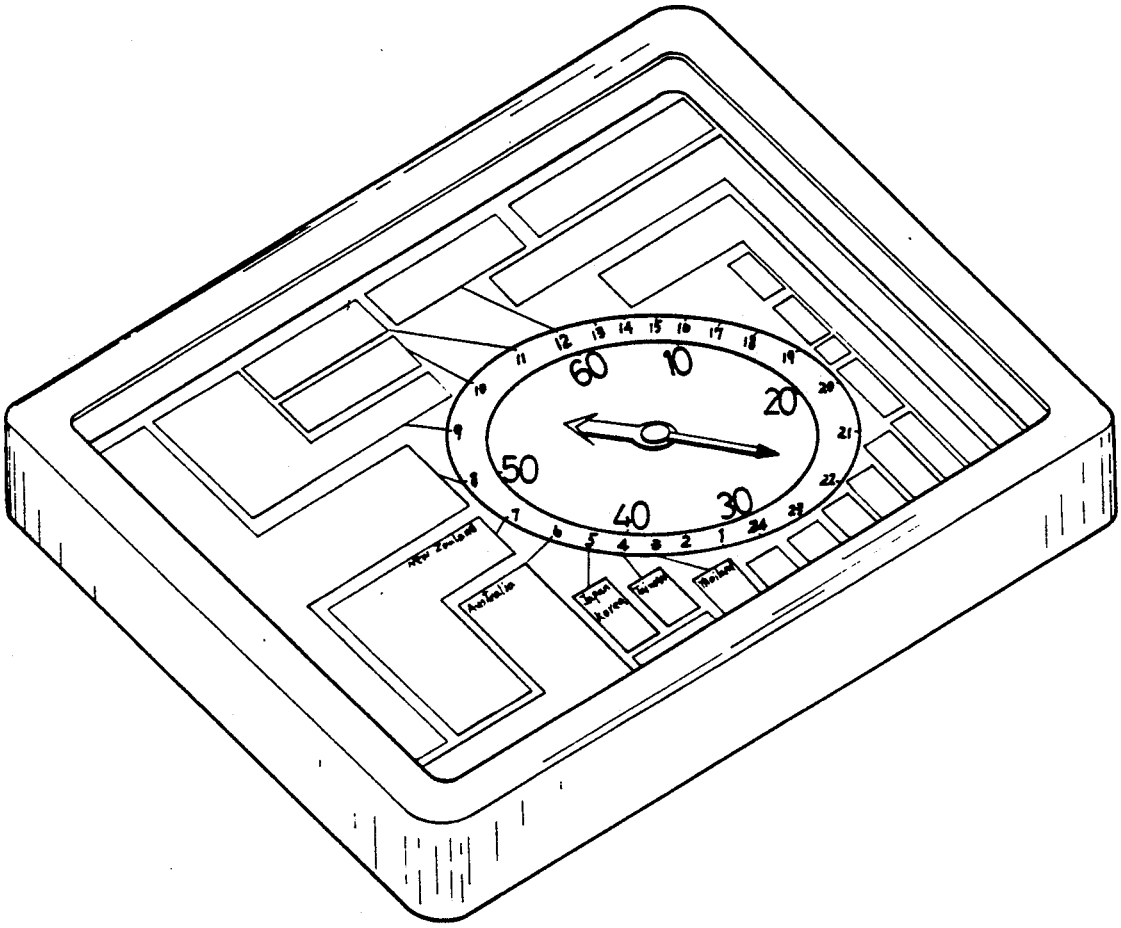
FIG. 5 is a perspective view of a second embodiment of world time clock according to the present invention.
Figure 6:
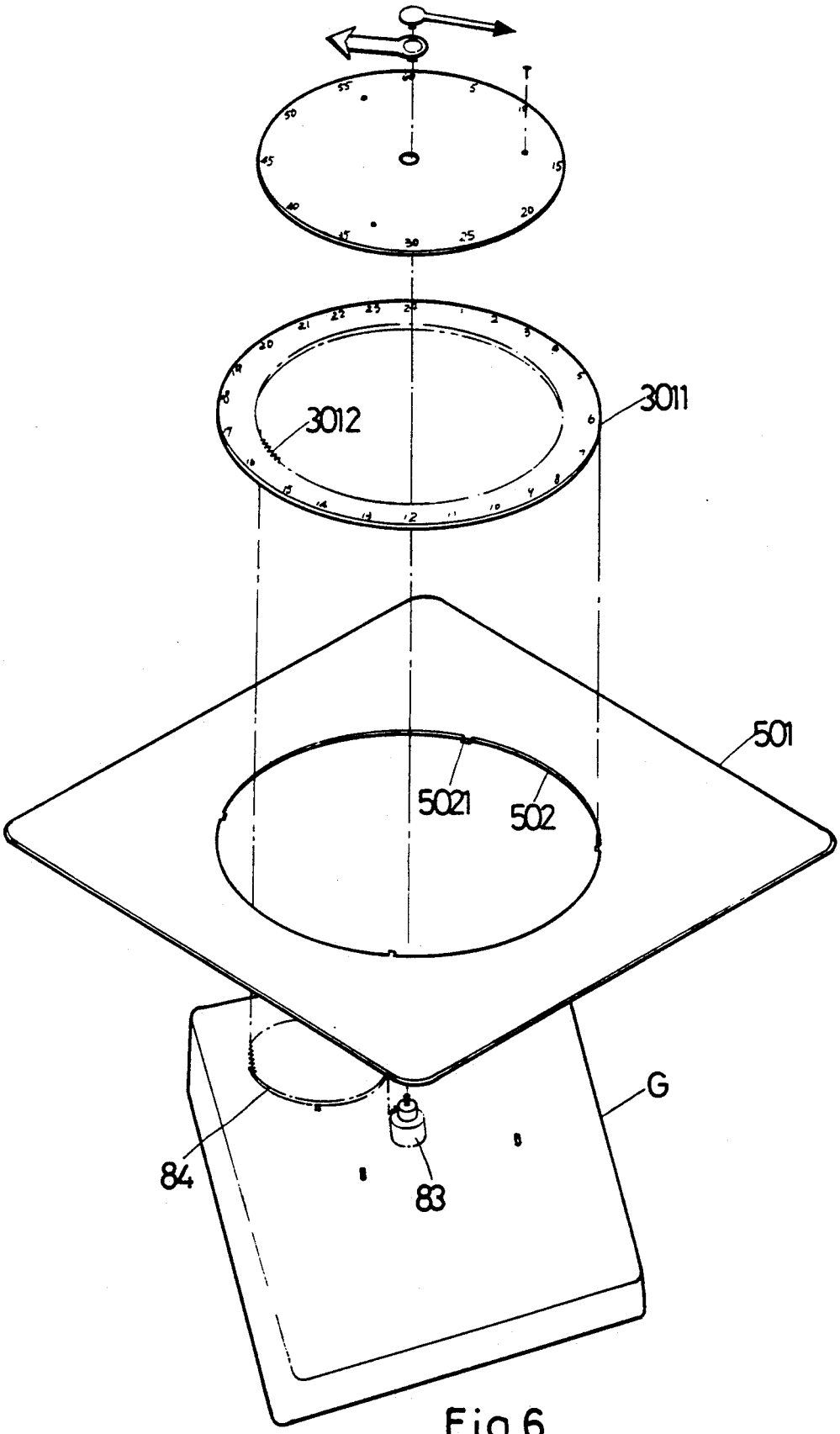
FIG. 6 is a partly perspective exploded view of the embodiment of FIG. 5.

Referring to FIGS. 1 through 4, there is a movement (G) having an hour shaft 83, a minute shaft 82, a seconds shaft 81, and a plurality of positioning posts 321 and axles 9. As shown in FIG. 2, a seconds plate 1 and a minute plate 2 are respectively mounted on the seconds shaft 81 and the minute shaft 82. There is a fixed plate 3 printed with a graduation on the top face thereof and mounted on the movement G. The fixed plate 3 has a recessed portion 31 around a center hole 33 thereon, which recessed portion 31 has a plurality of mounting holes 32 equidistantly made thereon. During assembly, screw nails 24 are used to respectively fasten through the mounting holes 32 in the positioning posts 321 to fixedly secure the fixed plate 3 onto the movement G.

Before mounting the minute plate 2, the seconds plate and the fixed plate 3, an hour plate 5 shall be mounted on the movement G at first, which hour plate 5 has a center hole 51 in the center thereof and is printed with the official name or national flag of world important countries according to world time zone classification. There is a T-type internal gear 4 coupled with the hour plate 5. The internal gear 4 has a center hole 41 at the center thereof and in diameter slightly larger than the center hole 51 of the hour plate 5. The hour plate 5 is driven to rotate by a driving gear wheel 84 which is engaged with the hour shaft 83 and the teeth of the internal gear 4. The axles 9 are mounted on the movement G around a circle and have each a pulley 90 mounted thereon, which pulley 90 has a circular groove 91 for mounting the hour plate 5. After the inner edge of the hour plate 5 is fastened in the groove 91 of the pulley 90 of every axle 9, the hour plate 5 becomes firmly positioned on the top of the movement G.

The seconds plate 1 and the minute plate 2 have each an index 11 or 21 for indicating time. The fixed plate 3 has a graduation 36 of 60 grades around the recessed portion 31 and another graduation or series of markings 35 of 24 grades around the outer edge thereof respectively for measuring of time. During operation, the arrows 52 which are printed on the face of the hour plate 5 follow the hour plate 5 to rotate for indicating the time according to respective time zone.

Figure 7:
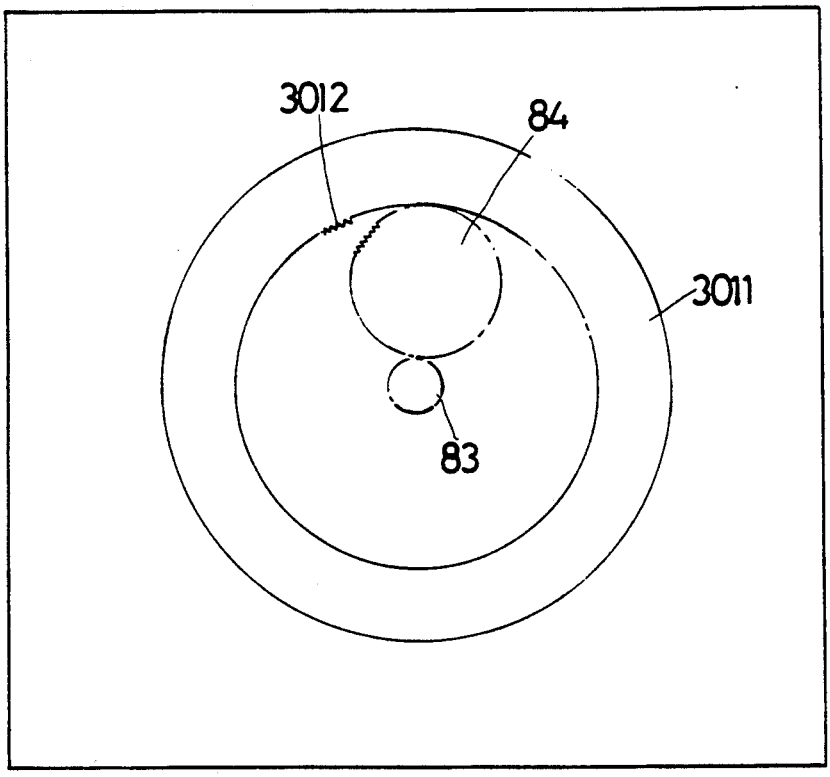
FIG. 7 is a schematic plain view of the embodiment of FIG. 5, in which the hour plate is designed to rotate in clockwise direction.
Figure 8:
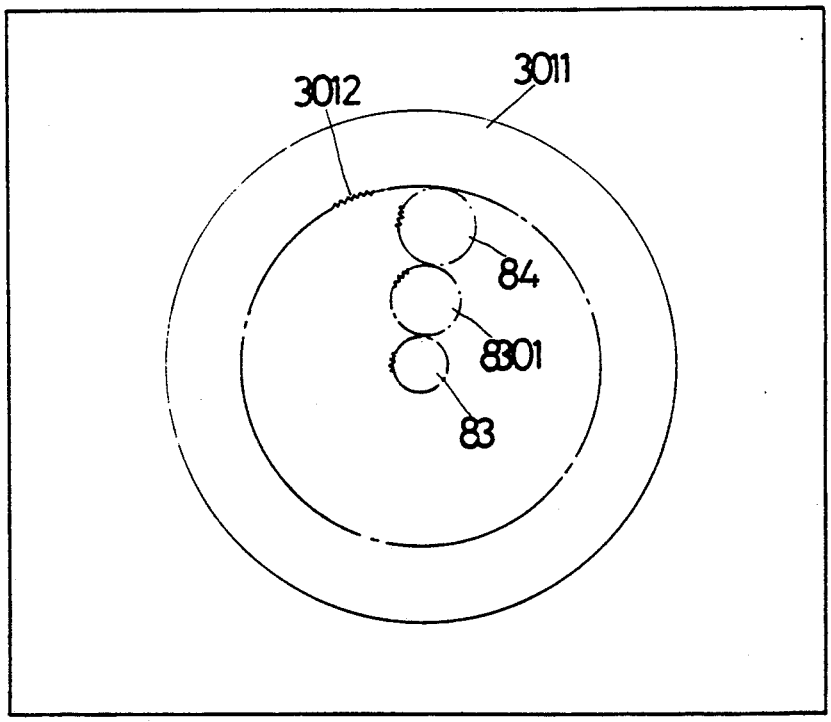
FIG. 8 is another schematic plain view of the embodiment of FIG. 5, in which the hour plate is designed to rotate in counter-clockwise direction.

Referring to FIGS. 5 through 8, therein illustrated is an alternate form of the present invention. There is a face plate 501 mounted on a movement G, which face plate 501 is printed with the official name or national flag of a plurality of countries and has a raised strip 5021 around a center hole 502. There is provided an hour plate 3011 which is printed with markings for 24 hours and has an internal gear 3012 mounted on its center hole. The internal gear 3012 is engaged with a driving gear wheel 84 which is simultaneously engaged with an hour shaft 83. Thus, the hour plate 3011 is carried to rotate at a speed of 24 hours for one round. As shown in FIGS. 7 and 8, when an additional gear wheel 8301 is engaged between the hour shaft 83 and the driving gear wheel 84, the hour plate 3011 will be driven to rotate in counter-clockwise direction at same speed. Under this arrangement, the location of the official name or national flag of the selected 24 countries printed on the face plate 501 shall be respectively changed.

Figure 9:
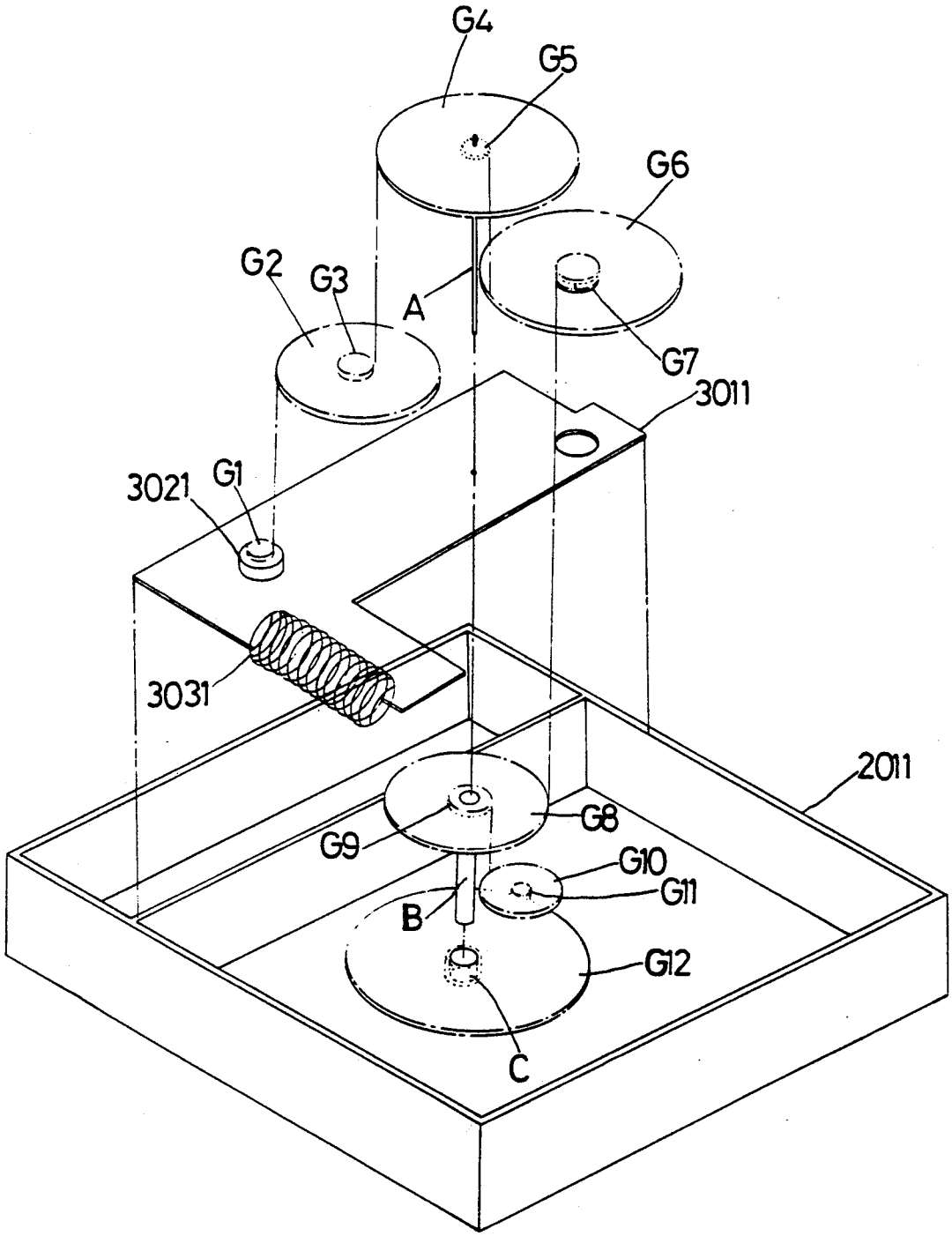
FIG. 9 is a perspective exploded view of a movement according to the present invention.
Figure 10:
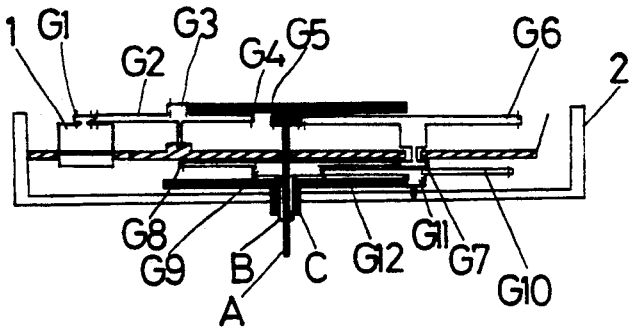
FIG. 10 is a schematic sectional view of the movement of FIG. 9.
Figure 11:
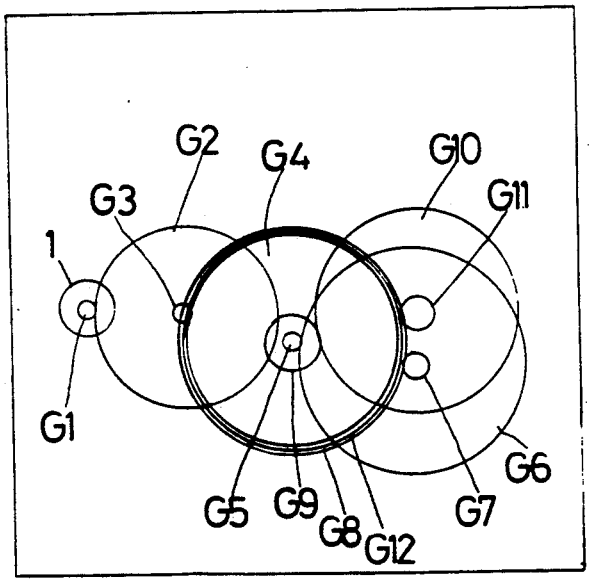
FIG. 11 is a schematic plain view of FIG. 10.

To match with the afore-said embodiments, a movement G shall be designed in such a manner that the hour shaft 83 is driven to rotate at a constant speed of 24 hours for one turn. This achievement is made and outlined hereinafter with reference to FIGS. 9, 10 and 11. There is a mounting plate 3011 fastened inside the casing 2 of a movement G for mounting a oscillator 3021 which has a gear G1 engaged with a gear wheel G2. The gear wheel G2 has a gear G3 concentrically mounted thereon and engaged with a gear wheel G4 which has 60 teeth and is mounted on a seconds shaft A. Each time the oscillator 3021 oscillates for a single cycle the gear wheel G4 is driven to move for one tooth which is equal to the range a seconds hand of a timepiece moves for one step (one second). Therefore, the gear G4 is driven to rotate at a speed of one minute for one turn. The gear wheel G4 has a gear G5 concentrically mounted thereon. The gear G5 has 8 teeth and engaged with a gear wheel G6 which has 60 teeth. Therefore, the gear wheel G6 rotates for one turn each time the gear G5 rotates for 7½ turns. The gear wheel G6 has a gear G7 concentrically mounted thereon, which gear G7 has 8 teeth and is engaged with a gear wheel G8 on a minute shaft B. The gear wheel G8 is designed in 64 teeth. Therefore, when the minute shaft B rotates for one turn the gear wheel G6 and the gear G7 rotate for 8 turns; when the seconds shaft A rotates for 7½ turns the gear wheel G6 and the gear G7 are driven to rotate for one turn; when the gear wheel G6 and the gear G7 rotate for 8 turns the minute shaft B is driven to rotate for one turn ($7.5\times8=60$). The gear wheel G8 of the minute shaft B has a gear G9 concentrically mounted thereon. The gear G9 is designed in 12 teeth and engaged with another gear wheel G10 which is designed in 48 teeth and mounted inside the casing 2. When the minute shaft B rotates for 4 turns, the gear wheel G10 is carried to rotate for 1 turn. The gear wheel G10 has a gear G11 concentrically mounted thereon. The gear G11 is designed in 8 teeth and engaged with a gear wheel G12 which is mounted on an hour shaft C. The gear wheel G12 is designed in 48 teeth. Therefore, when the gear G11 is carried to rotate for 6 turns the hour shaft C is driven to rotate for 1 turn; when the hour shaft C is carried to rotate for 1 turn the minute shaft B is driven to rotate for 24 turns.

I claim:

1. A world time clock for 24-hour indication, comprising:

a movement having a seconds shaft, a minute shaft, an hour shaft, and a plurality of positioning posts and axles, said hour shaft having a gear mounted thereon and being carried to rotate at a constant speed of 24 hours for one turn;

an hour plate having a center hole in the center thereof and being printed with the official name or national flag of world important countries according to world time zone classification;

a cushion plate being concentrically incorporated with said hour plate, said cushion plate having a center hole in diameter slightly smaller than the center hole of said hour plate;

an internal gear wheel concentrically coupled with said cushion plate permitting said cushion plate to be set in between said internal gear wheel and said hour plate;

a fixed plate having a recessed portion around a center hole thereon, a plurality of mounting holes corresponding to said positioning posts for the fastening there in of screw nails to secure said fixed plate to said movement, a graduation of 60 grades around said recessed portion and another graduation or series of markings of 24 grades around the outer edge thereof;

a seconds plate having a marking or index printed thereon and being mounted on said seconds shaft;

a minute plate having a marking or index printed thereon and being mounted on said minute shaft;

a driving gear wheel set between the gear on said hour shaft and said internal gear wheel and respectively engaged therewith; and a plurality of pulleys respectively mounted on said axles for holding the inner edge of said hour plate;

wherein said positioning posts, said axles and said driving gear wheel are spaced away from one another and respectively mounted on said movement within an area defined by the center hole of said hour plate; and wherein the official name or national flag of world countries on said hour plate follows said hour plate to rotate relative to said fixed plate for indicating time according to respective world time zone.

2. A world time clock according to claim 1, wherein said minute plate and said seconds plate are each designed to utilize a pattern or index to match with said hour plate for indicating time.

3. A world time clock according to claim 1, wherein a face panel which is printed with the official name or national flag of important countries according to world time zone classification is fixedly mounted on said movement to match with said hour Plate, and a gear is engaged between said hour shaft and the inner edge of said hour plate to drive said hour plate to rotate on said face plate for indicating world time.

4. A world time clock according to claim 1, wherein the gears engaged between said hour shaft and said hour plate are properly increased so that said hour plate is carried to rotate in counter direction for indicating time.

5. A world time clock according to claim 1, wherein said movement comprises an oscillator having a gear G1 engaged with a gear G2 which has a gear G3 concentrically mounted thereon and engaged with another gear G4 which is designed in 60 teeth and mounted on a seconds shaft A, which gear G4 having a gear G5 of 8 teeth concentrically mounted thereon to engage with a gear G6 of 60 teeth, which gear G6 having a gear G7 of 8 teeth concentrically mounted thereon to engage with a gear G8 of 64 teeth, which gear G8 being mounted on a minute shaft and having mounted thereon a concentric gear G9 of 12 teeth, which gear G9 being engaged with another gear G10 of 48 teeth, which gear G10 having a gear G11 of 8 teeth concentrically mounted thereon to engage with a gear G12 of 48 teeth which is mounted on an hour shaft C.

6. A world time clock according to claim 5, the gears of G5, G6, G7, G8, G9, G10, G11 and G12 are respectively connected to said hour shaft in such a manner that the gear G4 rotates for 60 turns said minute shaft is carried to rotate for one turn, and said minute shaft rotates for 24 turns said hour shaft is carried to rotate for one turn.

* * * * *